US006899065B2

(12) United States Patent
Hauser

(10) Patent No.: US 6,899,065 B2
(45) Date of Patent: May 31, 2005

(54) RADIAL-VALVE GEAR APPARATUS FOR BARREL ENGINE

(75) Inventor: Bret R. Hauser, Flower Mound, TX (US)

(73) Assignee: Thomas Engine Company, Covington, LA (US)

( * ) Notice: Subject to any disclaimer, the term of this patent is extended or adjusted under 35 U.S.C. 154(b) by 0 days.

(21) Appl. No.: 10/422,591

(22) Filed: Apr. 24, 2003

(65) Prior Publication Data

US 2004/0094103 A1 May 20, 2004

Related U.S. Application Data

(60) Provisional application No. 60/377,074, filed on Apr. 30, 2002.

(51) Int. Cl.[7] ..... F02B 75/18; F01L 1/26

(52) U.S. Cl. ..... 123/56.7; 123/90.6; 123/90.22

(58) Field of Search ..... 123/56.7, 56.2, 123/56.1, 56.6, 56.5, 43 AA, 90.6, 90.22

(56) References Cited

U.S. PATENT DOCUMENTS

| | | | |
|---|---|---|---|
| 127,747 A | 6/1872 | Donnelly | |
| 174,590 A | 3/1876 | Tesseyman | |
| 227,319 A | 5/1880 | Tegnander | |
| 344,593 A | 6/1886 | Peabody | |
| 349,775 A | 7/1886 | Wood | |
| 367,029 A | 7/1887 | Esty | |
| 571,129 A | 11/1896 | Schumacher | |
| 574,762 A | 1/1897 | Rowbotham | |
| 593,248 A | 11/1897 | Smith | |
| 600,971 A | 3/1898 | Singer | |

(Continued)

FOREIGN PATENT DOCUMENTS

| | | | |
|---|---|---|---|
| DE | 3214516 | 10/1983 | ..... F02B/71/00 |
| DE | 3342108 | 8/1984 | ..... F02B/75/32 |
| DE | 3408447 A1 | 9/1985 | |
| DE | 4015867 | 11/1991 | ..... F02B/57/00 |
| EP | 0 093 822 | 11/1983 | ..... F02B/57/10 |

(Continued)

OTHER PUBLICATIONS

US 6,019,073, 2/2000, Sanderson (withdrawn)

Stanglmaier R., Ryan T. and Souder J., "HCCI Operation of a Dual–Fuel Natural Gas Engine for Improved Fuel Efficiency and Ultra–Low NOx Emissions at Low to Moderate Engine Loads", 2001, SAE Paper 2001–01–1897.

(Continued)

*Primary Examiner*—Tony M. Argenbright
*Assistant Examiner*—Hyder Ali
(74) *Attorney, Agent, or Firm*—Gifford, Krass, Groh, Sprinkle, Anderson & Citkowski, P.C.

(57) ABSTRACT

A barrel engine has an elongated power shaft defining a longitudinal axis. A plurality of cylinders surround the longitudinal axis, with each having a closed end and an open end. An intake system introduces a combustible mixture of air and fuel into each of the cylinders. The power shaft has an intake lobe and an exhaust lobe extending therefrom. The intake system includes an intake valve and an exhaust valve for each of the cylinders. A valve actuation mechanism includes an intake rocker arm with one end in mechanical communication with the intake lobe, the other end in mechanical communication with the intake valve, and a mid-portion that is pivotally supported. The mechanism also includes an exhaust rocker arm with one end in mechanical communication with the exhaust lobe, the other end in mechanical communication with the exhaust valve, and a mid-portion that is pivotally supported.

11 Claims, 1 Drawing Sheet

U.S. PATENT DOCUMENTS

| | | | |
|---|---|---|---|
| 657,409 | A | 9/1900 | Gould |
| 669,234 | A | 3/1901 | Fuhmann et al. |
| 697,649 | A | 4/1902 | McLean |
| 706,320 | A | 8/1902 | Jenney |
| 706,494 | A | 8/1902 | Minogue |
| 749,864 | A | 1/1904 | James |
| 766,410 | A | 8/1904 | Alger |
| 771,037 | A | 9/1904 | Beck |
| 782,597 | A | 2/1905 | Chesire |
| 815,911 | A | 3/1906 | Eddy |
| 818,609 | A | 4/1906 | Butikofer |
| 839,300 | A | 12/1906 | Krohn |
| 848,665 | A | 4/1907 | Lombard |
| 850,295 | A | 4/1907 | Chappell |
| 851,293 | A | 4/1907 | Lehberger |
| 868,497 | A | 10/1907 | Smith |
| 893,038 | A | 7/1908 | Vadam |
| 893,181 | A | 7/1908 | Macomber |
| 897,963 | A | 9/1908 | Clayton et al. |
| 928,715 | A | 7/1909 | Thurber |
| 933,316 | A | 9/1909 | Macomber |
| 945,232 | A | 1/1910 | Harding |
| 947,008 | A | 1/1910 | Williams et al. |
| 968,969 | A | 8/1910 | Ord |
| 972,966 | A | 10/1910 | Williams |
| 980,491 | A | 1/1911 | Coleman |
| 998,363 | A | 7/1911 | De Lukacsevics |
| 999,047 | A | 7/1911 | Lehberger |
| 1,033,701 | A | 7/1912 | Lochum |
| 1,038,537 | A | 9/1912 | Dexter |
| 1,042,018 | A | 10/1912 | Macomber |
| 1,050,456 | A | 1/1913 | Helin |
| 1,053,799 | A | 2/1913 | Eslick |
| 1,063,456 | A | 6/1913 | Looney |
| 1,065,604 | A | 6/1913 | Gray |
| 1,076,179 | A | 10/1913 | Whitehead |
| 1,076,807 | A | 10/1913 | Anderson |
| 1,080,123 | A | 12/1913 | Pratt |
| 1,087,861 | A | 2/1914 | Alexander et al. |
| 1,097,150 | A | 5/1914 | Vallez |
| 1,104,539 | A | 7/1914 | Ord |
| 1,132,161 | A | 3/1915 | Cassady et al. |
| 1,132,581 | A | 3/1915 | Hein |
| 1,136,363 | A | 4/1915 | Pepper |
| 1,142,367 | A | 6/1915 | Reiche |
| 1,147,313 | A | 7/1915 | Desort |
| 1,170,918 | A | 2/1916 | Lundy |
| 1,177,126 | A | 3/1916 | Miller |
| 1,177,609 | A | 4/1916 | Edwards |
| 1,181,463 | A | 5/1916 | La Fontaine |
| 1,183,470 | A | 5/1916 | Lee |
| 1,183,777 | A | 5/1916 | Soules |
| 1,189,477 | A | 7/1916 | Peytoureau |
| 1,202,598 | A | 10/1916 | Simpson |
| 1,204,892 | A | 11/1916 | Macomber |
| 1,206,800 | A | 12/1916 | Batt |
| 1,207,846 | A | 12/1916 | Bradford |
| 1,209,995 | A | 12/1916 | Ord |
| 1,215,434 | A | 2/1917 | Trebert |
| 1,219,377 | A | 3/1917 | Davidson |
| 1,222,475 | A | 4/1917 | Sears |
| 1,226,789 | A | 5/1917 | Macomber |
| 1,228,101 | A | 5/1917 | Dutton |
| 1,229,009 | A | 6/1917 | Allison |
| 1,250,709 | A | 12/1917 | Tanner |
| 1,252,436 | A | 1/1918 | Hickey |
| 1,255,664 | A | 2/1918 | Syger |
| 1,256,382 | A | 2/1918 | Scott |
| 1,261,111 | A | 4/1918 | Fasey et al. |
| 1,275,494 | A | 8/1918 | Storte |
| 1,276,346 | A | 8/1918 | Gould |
| 1,277,964 | A | 9/1918 | Lovelace |
| 1,282,179 | A | 10/1918 | Brackett |
| 1,282,180 | A | 10/1918 | Brackett |
| 1,283,575 | A | 11/1918 | Shepard |
| 1,289,424 | A | 12/1918 | Faupel |
| 1,291,531 | A | 1/1919 | James et al. |
| 1,293,733 | A | 2/1919 | Duby |
| 1,298,191 | A | 3/1919 | Fasey |
| 1,307,045 | A | 6/1919 | Galbreath |
| 1,312,234 | A | 8/1919 | Carlson |
| 1,313,569 | A | 8/1919 | Wilks et al. |
| 1,316,679 | A | 9/1919 | Brackett |
| 1,321,045 | A | 11/1919 | Hutchinson |
| 1,321,046 | A | 11/1919 | Hutchinson |
| 1,324,520 | A | 12/1919 | Robbins |
| 1,324,534 | A | 12/1919 | Ambrose |
| 1,328,261 | A | 1/1920 | Blankenburg |
| 1,332,756 | A | 3/1920 | Root |
| 1,332,948 | A | 3/1920 | Murphy |
| 1,338,039 | A | 4/1920 | Porter |
| 1,338,185 | A | 4/1920 | Looney |
| 1,339,276 | A | 5/1920 | Murphy |
| 1,345,808 | A | 7/1920 | Reynolds |
| 1,345,940 | A | 7/1920 | Looney |
| 1,347,762 | A | 7/1920 | Shepard |
| 1,348,371 | A | 8/1920 | Murphy |
| 1,364,256 | A | 1/1921 | Des Engants et al. |
| 1,366,636 | A | 1/1921 | Conway |
| 1,370,856 | A | 3/1921 | Thomson |
| 1,374,315 | A | 4/1921 | Murphy |
| 1,374,915 | A | 4/1921 | Fasey |
| 1,375,140 | A | 4/1921 | Fasey |
| 1,377,383 | A | 5/1921 | Bair |
| 1,377,899 | A | 5/1921 | De Lukacsevics et al. |
| 1,379,775 | A | 5/1921 | Murphy |
| 1,379,774 | A | 6/1921 | Murphy |
| 1,382,485 | A | 6/1921 | Lukacsevics |
| 1,384,344 | A | 7/1921 | Powell |
| 1,389,873 | A | 9/1921 | Hult |
| 1,389,967 | A | 9/1921 | Murphy |
| 1,390,034 | A | 9/1921 | Howard |
| 1,393,174 | A | 10/1921 | Shepard |
| 1,405,224 | A | 1/1922 | Kenmonth |
| 1,407,293 | A | 2/1922 | Mott |
| 1,408,385 | A | 2/1922 | Newton |
| 1,413,363 | A | 4/1922 | Smith et al. |
| 1,427,632 | A | 8/1922 | Pryor |
| 1,445,686 | A | 2/1923 | Hult |
| 1,466,144 | A | 8/1923 | Murphy |
| 1,466,276 | A | 8/1923 | Egersdorfer |
| 1,476,307 | A | 12/1923 | Toth |
| 1,487,338 | A | 3/1924 | Kelley |
| 1,492,215 | A | 4/1924 | Nedoma |
| 1,503,741 | A | 8/1924 | Almen |
| 1,508,623 | A | 9/1924 | Somervell |
| 1,529,687 | A | 3/1925 | Bowen |
| 1,544,382 | A | 6/1925 | Entler |
| 1,545,925 | A | 7/1925 | Powell |
| 1,549,556 | A | 8/1925 | Kennedy |
| 1,556,300 | A | 10/1925 | Olsen |
| 1,565,184 | A | 12/1925 | Miller |
| 1,568,378 | A | 1/1926 | Gribojedoff |
| 1,569,525 | A | 1/1926 | Owens |
| 1,604,474 | A | 10/1926 | Nisbet |
| 1,610,060 | A | 12/1926 | Lind |
| 1,614,476 | A | 1/1927 | Hutchinson |
| 1,622,986 | A | 3/1927 | Weingartner |
| 1,625,841 | A | 4/1927 | Wright |
| 1,628,100 | A | 5/1927 | Bacon |
| 1,629,686 | A | 5/1927 | Dreisbach |

1,655,738 A 1/1928 Rasck
1,661,582 A 3/1928 Szydlowski
1,664,086 A 3/1928 Olsen
1,673,632 A 6/1928 Mattson
1,675,629 A 7/1928 Andrews
1,693,024 A 11/1928 Drummond
1,696,676 A 12/1928 Fuhr
RE17,273 E 4/1929 Michell
1,707,779 A 4/1929 Atkeson
1,716,621 A 6/1929 Cizek
1,717,999 A 6/1929 Olsen
1,736,507 A 11/1929 Peterson
1,738,512 A 12/1929 Andrews
1,745,821 A 2/1930 Gribojedoff
1,757,778 A 5/1930 Mehlum
1,762,650 A 6/1930 Boughton
1,770,311 A 7/1930 Keith
1,772,531 A 8/1930 Williams
1,772,977 A 8/1930 Arrighi
1,774,713 A 9/1930 Jahn et al.
1,779,032 A 10/1930 Cathcart
1,788,140 A 1/1931 Woolson
1,788,259 A 1/1931 Ward et al.
1,793,107 A 2/1931 Livingston
1,796,453 A 3/1931 Goehler
1,798,866 A 3/1931 Bleser
1,799,772 A 4/1931 Wormley
1,804,598 A 5/1931 Earl
1,807,087 A 5/1931 Finke
1,808,083 A 6/1931 Tibbetts
1,810,017 A 6/1931 Houston
1,813,259 A 7/1931 Schick
1,828,353 A 10/1931 Bleser
1,838,974 A 12/1931 Williams
1,839,592 A 1/1932 Reynolds
1,846,961 A 2/1932 Greening et al.
1,851,416 A 3/1932 Bauer
1,857,000 A 5/1932 Kleschka
1,864,248 A 6/1932 Holmes
1,866,398 A 7/1932 Craig
1,867,504 A 7/1932 Franklin
1,871,973 A 8/1932 Finke
1,876,506 A 9/1932 Lee
1,878,767 A 9/1932 Freund
1,880,224 A 10/1932 Wilsey
1,885,492 A 11/1932 Trew
1,886,492 A 11/1932 Mattson
1,896,449 A 2/1933 Kreidler
1,910,315 A 5/1933 Bleser
1,918,840 A 7/1933 Eriksen
1,939,350 A 12/1933 Jendrassik
1,945,727 A 2/1934 Braunwalder
1,948,526 A 2/1934 Liles
1,972,335 A 9/1934 Gardner
1,973,887 A 9/1934 Schick
1,976,286 A 10/1934 Kreidler
1,987,699 A 1/1935 Moore
1,988,252 A 1/1935 Pears
1,999,451 A 4/1935 Finlay
2,001,533 A 5/1935 Houston
2,026,705 A 1/1936 Pratt
2,027,891 A 1/1936 Weitzel
2,041,319 A 5/1936 Blomgren
2,057,147 A 10/1936 Holmes
2,062,219 A 11/1936 Ginn
2,065,790 A 12/1936 Braunwalder
2,068,038 A 1/1937 Prothero et al.
2,076,334 A 4/1937 Burns
2,083,510 A 6/1937 Stigers
2,091,949 A 9/1937 Alfaro
2,099,983 A 11/1937 Lake
2,118,804 A * 5/1938 Andersen ..... 123/56.7
2,121,706 A 6/1938 Little
2,126,860 A 8/1938 Alfaro
2,155,455 A 4/1939 Thoma
2,188,630 A 1/1940 Grahman
2,201,893 A 5/1940 Gadoux et al.
2,205,953 A 6/1940 Hall
2,237,621 A 4/1941 Herrmann
2,237,989 A 4/1941 Herrmann
2,239,063 A 4/1941 Taylor et al.
2,243,817 A 5/1941 Herrmann
2,243,820 A 5/1941 Herrmann
2,243,821 A 5/1941 Herrmann
2,243,822 A 5/1941 Herrmann
2,247,527 A 7/1941 Stinnes
2,250,512 A 7/1941 Vickers
2,269,106 A 1/1942 Hoffmann
2,272,691 A 2/1942 Chilton
2,274,097 A 2/1942 Sheerer
2,276,772 A 3/1942 Heap
2,280,375 A 4/1942 Chilton
2,301,175 A 11/1942 Earnshaw et al.
2,320,526 A 6/1943 Landis
2,326,912 A 8/1943 Allison
2,337,543 A 12/1943 Christopher
2,353,313 A 7/1944 Lake
2,366,595 A 1/1945 Christopher
2,368,444 A 1/1945 Blanding
2,369,002 A 2/1945 Allison
2,382,280 A 8/1945 Allison
2,384,292 A 9/1945 Feroy
2,399,743 A 5/1946 Kahl
2,401,466 A 6/1946 Davis et al.
2,406,292 A 8/1946 Hall
2,409,868 A 10/1946 Kahl
2,417,487 A 3/1947 Hall
2,439,265 A 4/1948 Schroeder
2,444,764 A 7/1948 Baker
2,447,314 A 8/1948 Carroll
2,456,164 A 12/1948 Youhouse
2,477,542 A 7/1949 Lane ..... 74/57
2,512,265 A 6/1950 Brigaudet ..... 123/43
2,556,585 A 6/1951 Jarvinen ..... 123/43
2,567,576 A 9/1951 Palumbo ..... 74/56
2,622,567 A 12/1952 Myard ..... 121/101
2,647,363 A 8/1953 Scott ..... 60/13
2,650,676 A 9/1953 Jamotte ..... 184/6
2,664,866 A 1/1954 Fulke
2,767,589 A 10/1956 Redrup et al. ..... 74/57
2,770,140 A 11/1956 Palumbo ..... 74/56
2,770,224 A 11/1956 Ericson ..... 123/48
2,770,225 A 11/1956 Palumbo ..... 123/58
2,776,649 A 1/1957 Fenske ..... 123/58
2,781,749 A 2/1957 Stucke ..... 123/51
2,783,751 A 3/1957 Karlan ..... 123/58
2,856,781 A 10/1958 Forbes ..... 74/56
2,875,701 A 3/1959 Ebert ..... 103/162
2,949,100 A 8/1960 Peterson ..... 123/43
2,962,008 A 11/1960 Hopkins ..... 123/45
2,966,899 A 1/1961 Herrmann ..... 123/58
2,983,265 A 5/1961 Herrmann ..... 123/58
2,994,188 A 8/1961 Howard ..... 60/13
3,039,676 A 6/1962 Mikina ..... 230/173
3,040,721 A 6/1962 Schotthoefer ..... 123/47
3,068,709 A 12/1962 Peterson ..... 74/57
3,078,832 A 2/1963 Braine ..... 123/41.65
3,107,541 A 10/1963 Parsus ..... 74/57
3,126,835 A 3/1964 Kline ..... 103/162
3,169,514 A 2/1965 Girodin ..... 123/58
3,170,444 A 2/1965 Haddon ..... 123/41.34
3,182,644 A 5/1965 Drtina ..... 123/58

| | | | | |
|---|---|---|---|---|
| 3,202,141 | A | 8/1965 | Lovell | 123/1 |
| 3,306,269 | A | 2/1967 | Dimmock, Jr. | 123/15 |
| 3,326,193 | A | 6/1967 | Wahlmark | 123/43 |
| 3,333,577 | A | 8/1967 | Mongitore | 123/18 |
| 3,359,864 | A | 12/1967 | Hamlin | 91/175 |
| 3,385,051 | A | 5/1968 | Kelly | 60/24 |
| 3,396,709 | A | 8/1968 | Robicheaux | 123/45 |
| 3,403,668 | A | 10/1968 | Schlotter | 123/197 |
| 3,407,593 | A | 10/1968 | Kelly | 60/24 |
| 3,408,898 | A | 11/1968 | Hamlin | |
| 3,456,630 | A | 7/1969 | Karlan | 123/58 |
| 3,570,463 | A | 3/1971 | Nelson | 123/122 |
| 3,587,638 | A | 6/1971 | Poole | 123/45 |
| 3,598,095 | A | 8/1971 | Odawara | 123/58 |
| 3,626,911 | A | 12/1971 | Shaw | 123/45 |
| 3,659,496 | A | 5/1972 | Alras | 123/45 |
| 3,673,991 | A | 7/1972 | Winn | 123/58 |
| 3,687,117 | A | 8/1972 | Panariti | 123/43 |
| 3,695,237 | A | 10/1972 | Londo | 123/43 |
| 3,745,887 | A | 7/1973 | Striegl | 92/146 |
| 3,745,981 | A | 7/1973 | Warner | 123/58 |
| 3,786,790 | A | 1/1974 | Plevyak | 123/58 |
| 3,805,749 | A | 4/1974 | Karlan | 123/58 |
| 3,807,370 | A | 4/1974 | Baugh | 123/43 |
| 3,828,741 | A | 8/1974 | Bixier | 123/58 |
| 3,830,208 | A | 8/1974 | Turner | 123/43 |
| 3,844,258 | A | 10/1974 | Howell | 123/43 |
| 3,854,284 | A | 12/1974 | Denker | 60/39.61 |
| 3,895,614 | A | 7/1975 | Bailey | 123/67 |
| 3,899,880 | A | 8/1975 | Rohs | 60/39.61 |
| 3,902,466 | A | 9/1975 | Gulko | 123/43 |
| 3,902,468 | A | 9/1975 | Turner | 123/43 |
| 3,905,338 | A | 9/1975 | Turner | 123/43 |
| 3,913,534 | A | 10/1975 | Bratten | 123/8.49 |
| 3,923,018 | A | 12/1975 | Markowitz | 123/43 |
| 3,929,107 | A | 12/1975 | Renger | 123/32 |
| 3,939,809 | A | 2/1976 | Rohs | 123/58 |
| 3,943,895 | A | 3/1976 | Howell | 123/58 |
| 3,945,359 | A | 3/1976 | Asaga | 123/58 |
| 3,968,776 | A | 7/1976 | Rund | 123/43 |
| 3,970,055 | A | 7/1976 | Long | 123/43 |
| 3,973,531 | A | 8/1976 | Turner | 123/43 |
| 4,022,167 | A | 5/1977 | Kristiansen | 123/43 |
| 4,022,168 | A | 5/1977 | Sprague | 123/43 |
| 4,023,542 | A | 5/1977 | Ango | 123/58 |
| 4,060,060 | A | 11/1977 | Turner | 123/43 |
| 4,084,555 | A | 4/1978 | Outlaw | 123/58 |
| 4,127,096 | A | 11/1978 | Townsend | 123/41.56 |
| 4,129,101 | A | 12/1978 | Townsend | 123/41.56 |
| 4,138,930 | A | 2/1979 | Searle | 92/70 |
| 4,149,498 | A | 4/1979 | Ferrell | 123/58 |
| 4,157,079 | A | 6/1979 | Kristiansen | 123/43 |
| 4,185,508 | A | 1/1980 | Hardt | 74/53 |
| 4,195,600 | A | 4/1980 | Shingai | 123/73 |
| 4,213,427 | A | 7/1980 | Di Stefano | 123/43 |
| 4,219,001 | A | 8/1980 | Kumagai et al. | 123/169 |
| 4,250,843 | A | 2/1981 | Chang | 123/43 |
| RE30,565 | E | 4/1981 | Kristiansen | |
| 4,287,858 | A | 9/1981 | Anzalone | 123/43 |
| 4,363,294 | A | 12/1982 | Searle | 123/43 |
| 4,366,784 | A | 1/1983 | Paul | 123/45 |
| 4,418,656 | A | 12/1983 | Stanton | 123/58 |
| 4,453,508 | A | 6/1984 | Groeger | 123/193 |
| 4,492,188 | A | 1/1985 | Palmer et al. | 123/58 |
| 4,502,427 | A | 3/1985 | Brille | 123/90.41 |
| 4,510,894 | A | 4/1985 | Williams | 123/48 |
| 4,520,765 | A | 6/1985 | Gerace | 123/27 |
| 4,553,508 | A | 11/1985 | Stinebaugh | 123/58 |
| 4,565,165 | A | 1/1986 | Papanicolaou | 123/51 |
| 4,571,946 | A | 2/1986 | Demopoulos | 60/618 |
| 4,592,309 | A | 6/1986 | Williams | 123/39 |
| 4,610,223 | A | 9/1986 | Karian | 123/58 |
| 4,632,081 | A | 12/1986 | Giuliani et al. | 123/198 |
| 4,635,590 | A | 1/1987 | Gerace | 123/27 |
| 4,648,358 | A | 3/1987 | Sullivan et al. | 123/43 |
| 4,768,481 | A | 9/1988 | Wood | 123/254 |
| 4,834,033 | A | 5/1989 | Larsen | 123/58 |
| 4,867,107 | A | 9/1989 | Sullivan et al. | 123/43 |
| 4,867,121 | A | 9/1989 | Bivona et al. | 123/197 |
| 4,915,064 | A | 4/1990 | Mannerstedt, deceased et al. | 123/58 |
| 4,960,082 | A | 10/1990 | Sullivan et al. | 123/43 |
| 4,974,555 | A | 12/1990 | Hoogenboom | 123/56 |
| 4,974,556 | A | 12/1990 | Royse | 123/58 |
| 4,996,953 | A | 3/1991 | Buck | 123/58 |
| 5,009,198 | A | 4/1991 | Sullivan et al. | 123/43 |
| 5,014,653 | A | 5/1991 | Sullivan et al. | 123/43 |
| 5,016,580 | A | 5/1991 | Gassman | 123/58 |
| 5,029,558 | A | 7/1991 | Sullivan | 123/43 |
| 5,070,825 | A | 12/1991 | Morgan | 123/43 |
| 5,083,532 | A | 1/1992 | Wiesen | 123/58 |
| 5,103,778 | A | 4/1992 | Usich, Jr. | 123/58 |
| 5,140,953 | A | 8/1992 | Fogelberg | 123/58 |
| 5,159,902 | A | 11/1992 | Grimm | 123/43 |
| 5,209,190 | A | 5/1993 | Paul | 123/43 |
| 5,218,933 | A | 6/1993 | Ehrlich | 123/56 |
| 5,228,415 | A | 7/1993 | Williams | 123/51 |
| 5,322,042 | A | 6/1994 | di Priolo et al. | 123/263 |
| 5,323,738 | A | 6/1994 | Morse | 123/43 |
| 5,329,893 | A | 7/1994 | Drangel et al. | 123/78 |
| 5,351,657 | A | 10/1994 | Buck | 123/43 |
| 5,375,567 | A | 12/1994 | Lowi, Jr. | 123/56.8 |
| 5,437,251 | A | 8/1995 | Anglim et al. | 123/56.3 |
| 5,443,043 | A | 8/1995 | Nilsson et al. | 123/48 |
| 5,452,689 | A | 9/1995 | Karlan | 123/56.2 |
| 5,456,220 | A | 10/1995 | Candler | 123/43 |
| 5,467,757 | A | 11/1995 | Yanagihara et al. | 123/305 |
| 5,476,072 | A | 12/1995 | Guy | 123/48 |
| 5,507,253 | A | 4/1996 | Lowi, Jr. | 123/56.9 |
| 5,517,953 | A | 5/1996 | Wiesen | 123/51 |
| 5,535,716 | A | 7/1996 | Sato et al. | 123/279 |
| 5,551,383 | A | 9/1996 | Novotny | 123/51 |
| 5,566,578 | A | 10/1996 | Rose | 74/57 |
| 5,636,561 | A | 6/1997 | Pecorari | 91/499 |
| 5,647,308 | A | 7/1997 | Biagini | 123/56.2 |
| 5,704,332 | A | 1/1998 | Motakef | 123/225 |
| 5,743,220 | A | 4/1998 | Guarner-Lans | 123/56.9 |
| 5,749,337 | A | 5/1998 | Palatov | 123/56.2 |
| 5,762,039 | A | 6/1998 | Gonzalez | 123/197.3 |
| 5,765,512 | A | 6/1998 | Fraser | 123/54.1 |
| 5,799,629 | A | 9/1998 | Lowi, Jr. | 123/56.8 |
| 5,813,372 | A | 9/1998 | Manthey | 123/43 |
| 5,832,880 | A | 11/1998 | Dickey | 123/25 |
| 5,875,743 | A | 3/1999 | Dickey | 123/25 |
| 5,890,462 | A | 4/1999 | Bassett | 123/56.2 |
| 5,894,820 | A | 4/1999 | Baeta | 123/56.1 |
| 5,904,044 | A | 5/1999 | White | 60/443 |
| 5,950,580 | A | 9/1999 | Birckbichler | 123/56.2 |
| 5,992,357 | A | 11/1999 | Tasi | 123/56.2 |
| 6,003,480 | A | 12/1999 | Quayle et al. | 123/56.1 |
| 6,089,195 | A | 7/2000 | Lowi, Jr. | 123/53.6 |
| 6,092,512 | A | 7/2000 | Ma | 123/568.15 |
| 6,260,520 | B1 | 7/2001 | Van Reatherford | 123/48 |
| 6,698,394 | B2 * | 3/2004 | Thomas | 123/241 |

FOREIGN PATENT DOCUMENTS

| | | | |
|---|---|---|---|
| EP | 0 136 565 | 4/1985 | F02B/61/06 |
| FR | 20203 | 10/1899 | |
| FR | 416364 | 5/1910 | |
| FR | 433357 | 8/1911 | |
| FR | 624291 | 7/1927 | |
| FR | 711040 | 9/1931 | |

| | | | |
|---|---|---|---|
| FR | 2 557 659 | 7/1985 | ..... F16H/25/12 |
| FR | 2 566 460 | 12/1985 | ..... F02B/75/26 |
| FR | 2 707 700 | 1/1995 | ..... F02B/75/32 |
| GB | 113711 | 3/1918 | |
| GB | 377877 | 8/1932 | |
| JP | 55-23308 | 2/1980 | ..... F01B/3/04 |
| JP | 580183825 | 10/1983 | ..... F02B/75/26 |
| WO | WO 92/09798 | 6/1992 | ..... F02B/75/04 |
| WO | WO 92/09799 | 6/1992 | ..... F02B/75/04 |
| WO | WO 98/07973 | 2/1998 | ..... F02M/7/00 |
| WO | WO 00/57044 | 9/2000 | ..... F02B/57/08 |

OTHER PUBLICATIONS

"Engine Smoothness", 2000, www.fortunecity.com/silverstone/lancia/58/technical_school/engine/smoot.

"Reciprotating Combustion Engine", 2001, http://reciprotating.com/default.htm.

"Homogeneous–Charge Compression Ignition Stratified Charge Compression Ignition Engine Laboratory", 2000, http://www.ca.sandia.gov.

"SVD—A Unique Engine Concept", Feb. 2000, http://www.saab.com/home/GLOBAL/en/pressreleases.xml.

"Dynamics of the Swash Plate Mechanism" 1984, Proceedings of the 19845 Inter Compressor Engineering Conference.

"New Engine Excites Many in Auto Industry", 1998, http://www.detnews.com/1998/autos/9805/20/052001.htm.

Kawabata, Y., Nakagawa K. and Shoji, F., "Operating Characteristics of Natural Gas Fueled Homogeneous Charge Compression Ignition", 1998, Annual Technical Report Digest.

"Dyna–Cam Revolutionary Engine Design," 2001, http://www.dynacam.com.

Christensen, M., Johansson, B., and Einewall, P., "Homogeneous Charge Compression Ignition (HCCI) using isooctane, ethanol, and Natural Gas. A Comparison with Spark–Ignition Operation", 1997, SAE Paper 972874.

Hultqvist, A., Christensen, M., and Johansson, P., "A Study of the Homogeneous Charge Compression Ignition Combustion Process by Chemilluminescence Imaging", 1998, SAE Paper 1999–01–3680.

Gray A. and Ryan T., "Homogeneous Charge Compression Ignition (HCCI) of Diesel Fuel", 1997, SAE Paper 971676.

Ziph B. and Meijer R., "Variable Stroke Power Control for Stirling Engines", 1981, SAE Paper 810088.

Clucas D.M. and Raine J.K., "A New Wobble Drive with Particular Application in a Stirling Engine", 1994, IMechE vol. 208.

Kontarakis G., Collings N. and Ma T., "Demonstration of HCCI Using Single–Cylinder, Four–sroke SI Engine with Modified Valve Timing", 2000 SAE 2000–01–2870.

Pucher G., Gardener D., Bardon M. and Battista, V., "Alternative Combustion Systems for Piston Engines Involving Homogeneous Charge Compression Ignition Concepts—A Review of Studies Using Methanol, Gasoline, and Diesel Fuel", 1996, http://www.bcresearch.com.

Gill G.S. and Freudenstein F., "Minimization of Inertia–Induced Forces in Spherical Four–bar Mechanisms. Part 2: Wobble–Plate Engines", 1983, ASME.

Gill, G.S. and Freudenstein F., "Minimization of Inertis–Induced Forces in Spherical Four–bar Mechanisms. Part 1: The General Spherical Four–bar Linkage", 1983, ASME vol. 105/471.

Hardenberg H. and Buhl H., "The Mercedes–Benz Om 403 VA—A Standard Production, Compression–Ignition, Direct–Injection Multifuel Engine", 1982, SAE Paper 820028.

Hiroshi T. and Masaharu H., "Historical Review of the Wobbleplate and Scroll Type Compressors", 1990, SAE Paper 901737.

Li J., Chae J., Lee S. and Jeong J., "Modeling the Effects of Split Injection Scheme on Soot and NOx Emissions of Direct Injection Diesel Engines by a Phenomenological Combustion Model", 1996, SAE Paper 962062.

McLanahan J., "Barrel Aircraft Engines: Historical Anomaly or Stymied Innovation", 1998, SAE Paper 985597.

Olsson J., Erlandsson O. Johansson B. "Experiments and Simulation of a Six–Cylinder Homogeneous Charge Compression Ignition (HCCI) Engine", 2000, SAE Paper 2000–01–2867.

"Erickson MCC FE–120", 1001, www.ericksonmotors.com/fe–120.htm.

Miyagawa K. and Kayukawa H., "Development of the Swash Plate–Type Continuously Variable Displacement Compressor", 1998, SAE Paper 980290.

Sadashivappa K., Singaperumal M. and Narayanasamy K., "On the Efficiency of the Axial Piston Motor Considering Piston Form Deviations", 1995, Pergamon 0957–4158 (95) 00074–7.

Edge K.A. and Darling j., "The Pumping Dynamics of Swash Plate Piston Pumps", 1989, ASME vol. 111/307.

Thieme L. and Allen D., "Testing of a Variable–Stroke Stirling Engine", 1986, 21st Intersociety Energy Conversion Engineering Conference, Paper 869104.

Thieme L., "Initial Testing of a Variable STroke Stirling Engine", 1985, U.S. Dept. of Energy, NASA TM–86875.

Au M., Girard J., and Hiltner J., "Homogeneous Charge Com;pression Ignition", 2001 http://www.me.berkeley.edu/~mctai/heci.html.

Christensen M., Hultqvist A. and Johansson B., "Demonstrating the Multi–Fuel Capability of Homogeneous Charge Compression Ignition with Variable Compression Ratio", 1999, SAE Paper 1999–01–3679.

Christensen M. and Johansson B., "Influence of Mixture Quality on Homogeneous Charge Compression Ignition", 1998, SAE Paper 982454.

Christensen M., Johansson B, Amneus P., and Mauss F., "Supercharged Homogeneous Charge Compression Ignition (HCCI)", 1998, SAE Paper 980787.

Kraft M., Maigaard P. and Mauss F., "Homogeneous Charge Compression Ignition Engine: A Simulation Study on the Effects of Inhomogeneities", 2000, ASME 2000 Spring Technical Conference.

Kraft M., Maigaard P., Mauss F. and Christensen M., "Investigations of Combustion Emissions in a HCCI Engine Measurements and a New Computational Model 2000 28th International Symposium for Combustion", 4E12.

Maricq M., Munoz R., Yang J. and Anderson R., "Sooting Tendencies in an Air Forced Direct Injection Spark–Ignition (DISI) Engine", 2001, SAE Paper 2001–01–0255.

Manring N., "Slipper Tipping within an Axial–Piston Swash–Plate Type Hydrostatic Pump", 1998, ASME FPST–vol. 5.

Jinqu N., Fukai I. and Kurihara M., "The Development of a Fixed–displacement Single–sided Swash Plate a/c Compressor", 2001, SAE Paper 2001–01–0971.

Kaahaaina N., Simon A., Caton P. and Edwards C., "Use of Dynamic Valving to Achieve Residual–Affected Combustion", 2000, SAE Paper 2001–01–0549.

Stanglmaier R. and Robert C., "Homogeneous Charge Compression Ignition (HCCI): Benefits, Compromises, and Future Engine Applications", 1999, SAE Paper 19999–01–3682.

Thring R., "Homogeneous Charge Compression Ignition (HCCI) Engines", 1989, SAE Paper 892068.

Fiveland S., and Assanis D., "A Four–Stroke Homogeneous Charge Compression Ignition Engine Stimulation for Combustion and Performance Studies", 2000, SAE Paper 2000–01–0332.

Nishimura T., Umeda T., Tsuta T. and Fujiwara, M., "Dynamic Response Analysis of a Swash Plate Type Hydraulic Piston Pump", 1995, ASME/JSME Pressure Vessels and Piping Conference PVP–vol. 300.

Sheiretov T., Glabbeek W. and Cusano C., Simulative Friction and Wear Study of Retrofitted Swash Plate and Rolling Pistor Compressors, 1995.

Taya T., Kobayashi H., Kawaguchi M. and Inagaki M. "10PC20 Swash Plate Type Variable Displacement Compressor for Automobile Air Conditioners", 1992, SAE Paper 920260.

Ryan T. and Callahan T. "Homogeneous Charge Compression Ignition of Diesel Fuel", 1996, SAE Paper 961160.

Tsuta T., Iwamoto T. and Umeda T. "Combined Dynamic Response Analysis of a Piston–Slipper System and Libricants in Hydraulic Piston Pump", 1999, ASME PVP vol. 396.

Zhang X., Cho J., Nair S., Manring N., "Damping on the Swash Plate of an Axial–Piston Pump 2000", 2000, American Contro Conference.

"New Saab and Citroen Technology at Geneva", Automotive Engineering Online, SAE International, May 2000.

Herling, D., Smith, M., Baskaran, S., and Kupe J., "Application of Non–Thermal Plasma Assisted Catalyst Technology for Diesel Emission Reduction", 2000, SAE Paper 2000–01–3088.

Law, D., Kemp, D., Allen, J., Kirkpatrick, G., and Copland, T., "Controlled Combustion in an IC–Engine with a Fully Variable Valve Train", 2001, SAE Paper 2000–01–0251.

"Advanced Engine Technologies' OX2 Engine Poised as Alternative for Future World Energy Needs", Press Release, Thursday, Feb. 8, 4:34 p.m. Eastern Time (http://biz.yahoo.com/prnews/010208/ca_advance_4.html).

"Advanced Engine Technologies Unveils New Web Site", Press Release, Monday, Mar. 12, 12:00 p.m. Eastern Time (http://biz–yahoo.com/prnews/010312/lam013_2.html).

* cited by examiner

RADIAL-VALVE GEAR APPARATUS FOR BARREL ENGINE

CROSS-REFERENCE TO RELATED APPLICATIONS

This application claims priority to U.S. provisional patent application Ser. No. 60/377,074, filed Apr. 30, 2002, the entire contents of which is incorporated herein in by reference.

FIELD OF THE INVENTION

The present invention relates generally to internal combustion engines and, more specifically, to a valve actuation mechanism for barrel engines.

BACKGROUND OF THE INVENTION

Barrel engine configurations, such as the general class of engines shown in U.S. Pat. No. 5,749,337 to Palatov, hold potential for high power density packages. This is desirable in many applications, particularly those requiring mobile power sources such as automotive, marine and aviation. Barrel engines typically involve a grouping of power cylinders and pistons arranged in a circle with their axes parallel to a central power shaft. The geometry of the barrel engine requires that the intake and exhaust valves be actuated in a manner that is different than traditional in-line or vee-type engines. Conventional in-line or vee-type engine configurations commonly utilize a longitudinal camshaft, parallel to the primary crankshaft that includes actuation lobes for each intake and exhaust valve or valve set per cylinder. This conventional cam is driven via gear, chain, or belt drive from the primary crankshaft with valve timing dependent upon proper assembly of the components.

A barrel engine is not well suited to use a traditional longitudinal camshaft since the intake and exhaust valves actuate in a direction that is parallel to the axis of the main power output shaft (crankshaft). Plate-style cams are often used to actuate the valves of a barrel engine. In plate cam designs, the cam is generally flat and extends perpendicularly from the main output shaft. The plate cam has a contoured surface that engages valve stems or lifters to actuate the valves, which are generally perpendicular to the plate. Although this configuration reduces parts count, there are several disadvantages. Among them are the deformation of the cam plate as a result of high force requirements to actuate the exhaust valves as compared to the stiffness of the plate and plate-to-shaft attachment. Also, the plate cam design is difficult to design such that sufficient stiffness exists without undue component weight. This is compounded as the interface to the shaft is considered. Other disadvantages include the complexity of manufacturing a plate cam to actuate the valves as compared to conventional cam grinding techniques. The ability to include hydraulic lifters or to incorporate mechanical lash adjustment is also made more complicated by a plate cam design.

SUMMARY OF THE INVENTION

The present invention provides a barrel engine, including an engine housing having a first end and a second end. An elongated power shaft is longitudinally disposed in the engine housing and defines the longitudinal axis of the engine. A plurality of cylinders surrounds the longitudinal axis, with each cylinder having a closed end and an open end. Each cylinder has a central axis. The open ends of the cylinders are each generally directed towards the first end of the housing. An intake system is operable to introduce a combustible mixture of air and fuel into each of the cylinders. A track is disposed between the first end of the housing and the open ends of the cylinders such that a portion of the track is disposed generally in alignment with the central axis of each of the cylinders. The track has a cam surface that longitudinally undulates with respect to the open ends of the cylinders. A portion of the cam surface is disposed generally in alignment with the central axis of each of the cylinders. The track and the cylinders are rotatable with respect to each other such that the undulating cam surface moves with respect to the open ends of the cylinders. A piston is moveably disposed in each of the cylinders such that a combustion chamber is defined between the piston and the closed end of the cylinder. Each piston is in mechanical communication with the cam surface of the track such that as the cylinders and track move with respect to each other, the pistons reciprocate within the cylinders. Each piston is operable to compress the combustible mixture. The present invention provides an improvement wherein the power shaft has an intake lobe and an exhaust lobe extending therefrom. The intake system includes an intake valve and an exhaust valve for each of the cylinders. The valves are linearly moveable between an open and a closed position. A valve actuation mechanism is associated with each of the cylinders. The mechanism comprises an intake rocker arm having a first end disposed in mechanical communication with the intake lobe on the power shaft and a second end in mechanical communication with the intake valve. A mid-portion of the intake rocker arm is pivotally supported. An exhaust rocker arm has a first end disposed in mechanical communication with the exhaust lobe on the power shaft and a second end in mechanical communication with the exhaust valve. A mid-portion of the exhaust rocker arm is pivotally supported.

DETAILED DESCRIPTION OF THE PREFERRED EMBODIMENTS

Figure 1:
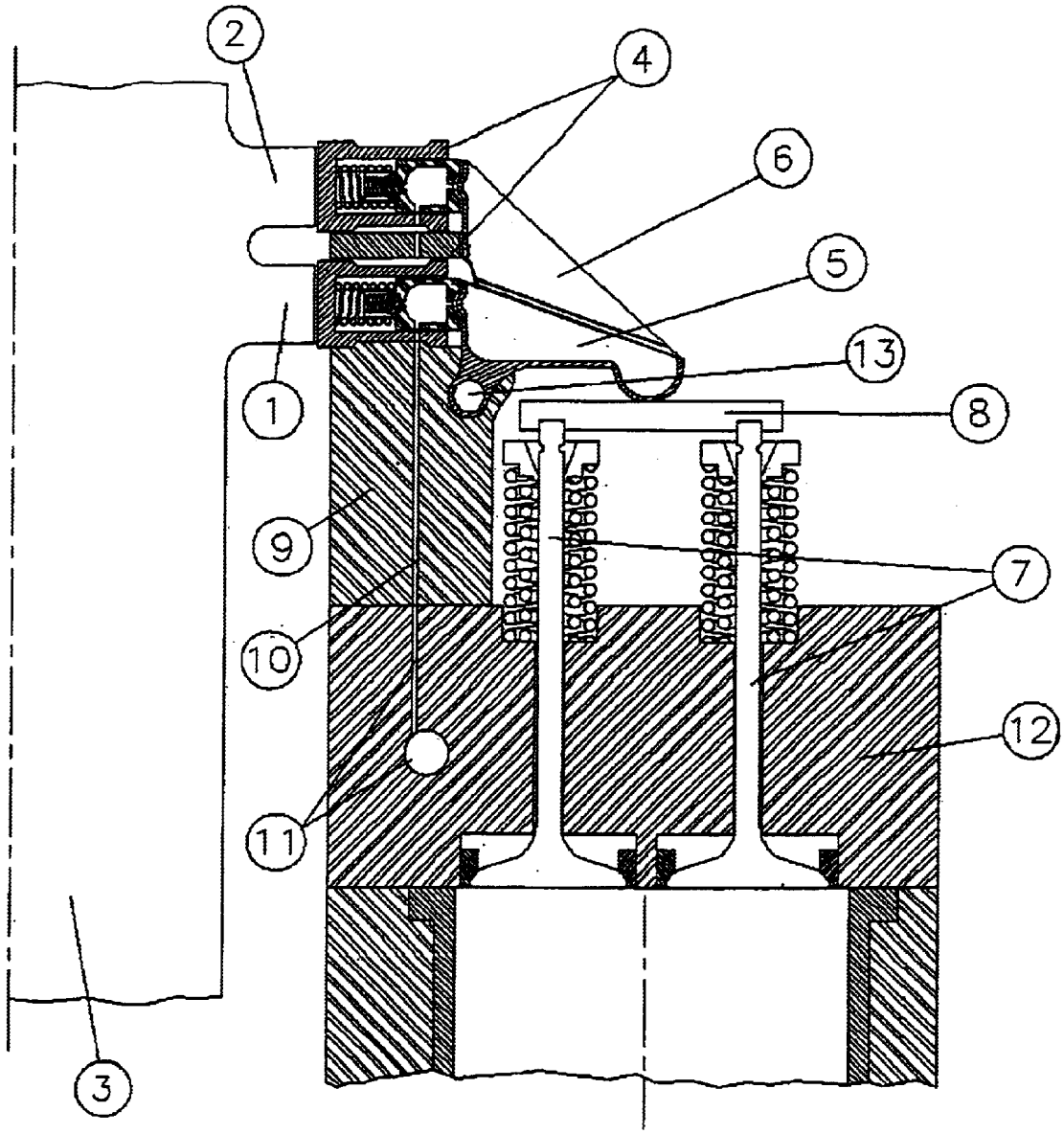
FIG. 1 is a cross-sectional view of a portion of a barrel engine showing an improved valve actuation mechanism according to the present invention.

The present invention provides for an alternative method of valve actuation that allows for improved stiffness and valve gear performance, improved ease of manufacture, easy inclusion of hydraulic lifter systems or mechanical lash adjustment, and can also be used to actuate fuel injection equipment in a more conventional and simplified approach. This is accomplished through the use of "L-shaped" rocker levers arranged radially to and actuated by common cam lobes on the main output shaft. One embodiment is illustrated in FIG. 1.

As shown in FIG. 1, the main output shaft 3 in a barrel engine has intake 1 and exhaust 2 cam lobes extending generally perpendicularly therefrom. The cam lobes 1 and 2 mate with mechanical or hydraulic lifters 4 arranged perpendicular to the main output shaft in a radial fashion. The lifters in turn actuate "L-shaped" intake 5 and exhaust 6 rocker levers that in turn actuate the valves 7. FIG. 1 illustrates the intake rocker lever 5 actuating a multiple intake valve set whereas the exhaust rocker lever 6 actuates a similar multiple exhaust valve set behind (hidden). In the case of multi-valve arrangements, a crossbar 8 may be used to provide a single point of actuation from the rocker levers for the valve set. Further, a single "lifter housing" 9 provides support and guidance for all lifters (mechanical or hydraulic) as well as oil passages 10 for hydraulic lifter systems which align with oil galleries and passages 11 in the cylinder head 12. The lifter housing 9 also provides a pivot 13 for both intake 5 and exhaust 6 rockers. As configured in FIG. 1, the common pivot pin 13 and relative position of the two cam lobes 1 and 2 provide for rocker levers of differing rocker ratios or mechanical advantages. In this way, the exhaust rocker lever 6 can be designed for improved mechanical advantage resulting in reduced follower to cam contact pressures. This is beneficial because the force required to open the exhaust valve(s) is typically much greater than that for the intake valve(s) due to the pressure within the cylinder at the opening event.

FIG. 1 illustrates the intake valves 7 and intake rocker lever 5 as being disposed in a plane that is generally parallel to the plane in which the exhaust valves (hidden) and exhaust rocker lever 6 reside. As will be clear to those of skill in the art, the intake valves 7 and the intake rocker lever 5 may be canted with respect to the exhaust valves and exhaust rocker 6 so as to provide room for larger valves, a hemispherical combustion chamber or other arrangements. In these situations, the rocker arm arrangement remains generally as shown, though some modification may be required depending on the angle of the valves.

The present invention preferably provides for single cam lobes 1 and 2 to be used to actuate all valves of the same type (intake or exhaust) within the engine. For example, this configuration would provide for a single intake and single exhaust valve lobe for a six-cylinder engine as opposed to six intake and six exhaust lobes for a conventional in-line or V-type engine. Further, the single intake and exhaust lobes are arranged on the power shaft 3 in a manner conventional to traditional camshafts. Therefore, conventional manufacturing techniques can be used as opposed to the non-traditional techniques of a plate cam. This should result in reduced cost due to economies of scale. The conceived valve gear apparatus also provides for increased stiffness as compared to plate cam designs, which can result in significant overall weight savings. Although depicted and discussed here in terms of valve actuation, the present invention can also be applied to the actuation of fuel injection equipment (not shown) or other mechanisms. The cam lobes 1 and 2 as described in this invention may be either cast or forged, as part of the power shaft 3, or separately, in which case they could be either fused, splined, threaded, bolted or welded to the power shaft 3.

An alternative configuration to the one shown in FIG. 1 would utilize pushrods between the lifter 4 and rocker levers 5 and 6. Pushrods may be used simply to accommodate a gap between the placement of the rocker and lifter or to provide for the irregular placement of rockers and lifters; made necessary due to requirements for a specific rocker ratio or other geometrical constraints.

The illustrated embodiment shows a single rocker arm actuating a pair of valves using a crossbar 8. Alternatively, multiple rocker arms may be used to actuate multiple valves. For example, two intake rocker arms may be provided to actuate two intake valves independently from one another, especially for applications where the two intake valves may be phased slightly differently from one another to generate swirl or other desirable effects in the combustion chamber. The same may be provided for exhaust valve actuation. In these arrangements, where additional rockers are used, additional intake cam lobes 5 and/or multiple exhaust lobes may be provided. Additional lobes may also be provided as needed to actuate fuel injection equipment. Various types of variable valve timing designs may be also applied to the present valve actuation approach.

While only two intake and exhaust valves are shown in the illustrated embodiment, it is highly likely that some configurations will require more or fewer intake or exhaust valves than the number discussed above. Therefore, more or fewer intake and/or exhaust valves may be utilized in the present invention.

Some of the key benefits of the invention are listed as follows.

1. Intake and exhaust valve actuation, as well as fuel injector or unit pump operation for multiple cylinders can be accomplished with reduced complexity by making common use of cam profiles among the various cylinders.
2. The stiffness of the overall valve gear or fuel actuation mechanism in a barrel engine configuration is increased through the use of "L-shaped" rocker levers as opposed to a plate-type cam mounted perpendicularly to the main shaft.
3. The manufacture of valve and fuel actuation cams as an integral part of the main shaft allows for the use of conventional cam manufacturing techniques.
4. A single lifter housing allows for a compact mechanism including placement and support of the rocker levers, placement and support of the cam followers or hydraulic lifters, and lubricant oil plumbing. This housing can be assembled separately from the main engine assembly in a sub-assembly process, improving the manufacturability of this part of the engine.
5. The orientation of the cam lobe surfaces, rocker levers, and valves allow for improved mechanical advantage for the exhaust rocker where cam contact stresses are higher than for the intake due to pressures within the cylinder at the time of valve opening. This can result in reduced wear and longer service life for the exhaust valve cam as compared to conventional designs.

As will be clear to those of skill in the art, the preferred embodiments of the present invention, disclosed herein, may be altered in various ways without departing from the scope or teaching of the present invention. For example, the present invention may be combined with any of the teachings of copending U.S. patent application Ser. No. 10/021,192, filed Oct. 30, 2001, the entire contents of which are incorporated herein by reference.

I claim:

1. In a barrel engine having:

an engine housing having a first end and a second end;

a elongated power shaft longitudinally disposed in the engine housing and defining a longitudinal axis of the engine;

a plurality of cylinders surrounding the longitudinal axis, each cylinder having a closed end and an open end, each cylinder having a central axis, the open ends of the cylinders each being generally directed toward the first end of the housing;

an intake system operable to introduce a combustible mixture of air and fuel into each of the cylinders;

a track disposed between the first end of the housing and the open ends of the cylinders such that a portion of the track is disposed generally in alignment with the central axis of each of the cylinders, the track having a cain surface that longitudinally undulates with respect to the open ends of the cylinders, a portion of the cam surface being disposed generally in alignment with the central axis of each of the cylinders, the track and the cylinders being rotatable with respect to each other such that the undulating cam surface moves with respect to the open ends of the cylinders; and a piston movably disposed in each of the cylinders such that a combustion chamber is defined between the piston and the closed end of the cylinder, each piston being in mechanical communication with the cam surface of the track such that as the cylinders and track move with respect to each other, the pistons reciprocate within the cylinders, each piston being operable to compress the combustible mixture;

wherein the improvement comprises:

the power shaft having an intake lobe and an exhaust lobe extending therefrom;

the intake system including an intake valve and an exhaust valve for each of the cylinders, the valves being linearly movable between an open and closed position; and a valve actuation mechanism associated with each cylinder, the mechanism comprising an intake rocker arm having a first end and a second end, the second end being in mechanical communication with the intake valve, the intake rocker arm further having a midportion that is pivotally supported, the mechanism further comprising an exhaust rocker arm having a first end and a second end, the second end being in mechanical communication with the exhaust valve, the exhaust rocker arm further having a midportion that is pivotally supported; and an intake hydraulic lifter and an exhaust hydraulic lifter each having a first and a second end, the first end of the intake hydraulic lifter being in mechanical communication with the intake lobe and the second end of the intake hydraulic lifter being in mechanical communication with the first end of the intake rocker arm, and the first end of the exhaust hydraulic lifter being in mechanical communication with the exhaust lobe and the second end of the exhaust hydraulic lifter being in mechanical communication with the first end of the exhaust rocker arm.

2. The engine according to claim 1, wherein the intake and exhaust valves move in a line that is generally parallel to the longitudinal axis of the engine.

3. The engine according to claim 1, wherein the intake and exhaust valves move in a line that is not parallel to the longitudinal axis of the engine.

4. The engine according to claim 1, wherein the intake lobe and the exhaust lobe extend generally perpendicularly outwardly from the power shaft.

5. The engine according to claim 1, wherein the first end of the intake hydraulic lifter is in sliding contact with the intake lobe and the first end of the exhaust hydraulic lifter is in sliding contact with the exhaust lobe.

6. The engine according to claim 1, wherein the intake system further includes a second intake valve and a second exhaust valve, the second end of the intake rocker arm being in mechanical communication with both intake valves and the second end of the exhaust rocker arm being in mechanical communication with both exhaust valves.

7. In a barrel engine having:

an engine housing having a first end and a second end;

a elongated power shaft longitudinally disposed in the engine housing and defining a longitudinal axis of the engine;

a plurality of cylinders surrounding the longitudinal axis, each cylinder having a closed end and an open end, each cylinder having a central axis, the open ends of the cylinders each being generally directed toward the first end of the housing;

an intake system operable to introduce a combustible mixture of air and fuel into each of the cylinders;

a track disposed between the first end of the housing and the open ends of the cylinders such that a portion of the track is disposed generally in alignment with the central axis of each of the cylinders, the track having a cam surface that longitudinally undulates with respect to the open ends of the cylinders, a portion of the cam surface being disposed generally in alignment with the central axis of each of the cylinders, the track and the cylinders being rotatable with respect to each other such that the undulating cam surface moves with respect to the open ends of the cylinders; and a piston movably disposed in each of the cylinders such that a combustion chamber is defined between the piston and the closed end of the cylinder, each piston being in mechanical communication with the cam surface of the track such that as the cylinders and track move with respect to each other, the pistons reciprocate within the cylinders, each piston being operable to compress the combustible mixture;

wherein the improvement comprises:

the power shaft having an intake lobe and an exhaust lobe extending therefrom;

the intake system including an intake valve and an exhaust valve for each of the cylinders, the valves being linearly movable between an open and closed position; and a valve actuation mechanism associated with each cylinder, the mechanism comprising an intake rocker arm having a first end disposed in mechanical communication with the intake lobe on the power shaft, a second end in mechanical communication with the intake valve, and a midportion that is pivotally supported, the mechanism further comprising an exhaust rocker arm having a first end disposed in mechanical communication with the exhaust lobe on the power shaft, a second end in mechanical communication with the exhaust valve, and a midportion that is pivotally supported;

wherein the intake and exhaust valves move in a line that is not parallel to the longitudinal axis of the engine.

8. The engine according to claim 7, wherein the intake lobe and the exhaust lobe extend generally perpendicularly outwardly from the power shaft.

9. The engine according to claim 7, further comprising an intake hydraulic lifter and an exhaust hydraulic lifter each having a first and a second end, the first end of the intake hydraulic lifter being in mechanical communication with the intake lobe and the second end of the intake hydraulic lifter being in mechanical communication with the first end of the intake rocker arm, and the first end of the exhaust hydraulic lifter being in mechanical communication with the exhaust lobe and the second end of the exhaust hydraulic lifter being in mechanical communication with the first end of the exhaust rocker arm.

10. The engine according to claim 9, wherein the first end of the intake hydraulic lifter is in sliding contact with the intake lobe and the end of the exhaust hydraulic lifter is in sliding contact with the exhaust lobe.

11. The engine according to claim 7, wherein the intake system further includes a second intake valve and a second exhaust valve, the second end of the intake rocker arm being in mechanical communication with both intake valves and the second end of the exhaust rocker arm being in mechanical communication with both exhaust valves.

* * * * *

UNITED STATES PATENT AND TRADEMARK OFFICE

CERTIFICATE OF CORRECTION

PATENT NO. : 6,899,065 B2
DATED : May 31, 2005
INVENTOR(S) : Bret R. Hauser

It is certified that error appears in the above-identified patent and that said Letters Patent is hereby corrected as shown below:

Column 1,
Line 8, replace “herein in by” with -- herein by --.

Column 4,
Line 49, replace “a elongated” with -- an elongated --.
Line 62, replace “cain” with -- cam --.

Column 5,
Lines 16-17, replace “position; and” to -- position --.
Line 60, replace “a elongated” with -- an elongated --.

Column 6,
Line 58, replace “the end” with -- the first end --.

Signed and Sealed this

Twenty-seventh Day of September, 2005

JON W. DUDAS
*Director of the United States Patent and Trademark Office*